United States Patent [19]

Canfield

[11] Patent Number: 4,583,577

[45] Date of Patent: Apr. 22, 1986

[54] CONTAINER INSULATOR

[75] Inventor: Charles L. Canfield, Dallas, Tex.

[73] Assignees: Pat Canfield; Cindy Canfield; Cammy Canfield, all of Dallas, Tex.

[21] Appl. No.: 644,341

[22] Filed: Aug. 27, 1984

[51] Int. Cl.[4] ..... B65D 3/06; B65D 81/14; B65D 8/00; B65D 23/08

[52] U.S. Cl. ..... 150/52 R; 215/13 R; 215/100.5; 229/89

[58] Field of Search ..... 150/52 R; 229/89, 90; 215/100.5, 13

[56] References Cited

U.S. PATENT DOCUMENTS

| | | | |
|---|---|---|---|
| 538,699 | 5/1895 | Redlich | 229/89 |
| 2,142,301 | 1/1939 | Buchalter | 150/52 R |
| 2,589,645 | 3/1952 | Tiegel | 229/90 |
| 2,757,790 | 8/1956 | Gattuso . | |
| 3,680,726 | 8/1972 | Massey . | |
| 3,813,801 | 6/1974 | VanderSchaaf | 150/52 R |
| 3,910,328 | 10/1975 | Marcoux | 150/52 R |
| 4,268,567 | 5/1981 | Harmony . | |
| 4,282,279 | 8/1981 | Strickland . | |

*Primary Examiner*—George E. Lowrance

*Attorney, Agent, or Firm*—Richards, Harris, Medlock & Andrews

[57] ABSTRACT

An insulating cover is provided for a beverage container (24). A resilient cylindrical sidewall member (10) is slit (18) with overlapping edges (20 and 22) for expansion and contraction. A plurality of bottom segments (12) depend from the sidewall in an iris-like configuration to enlarge or contract with the sidewall (10) while maintaining support for the enclosed container (24).

7 Claims, 3 Drawing Figures

FIG. 1
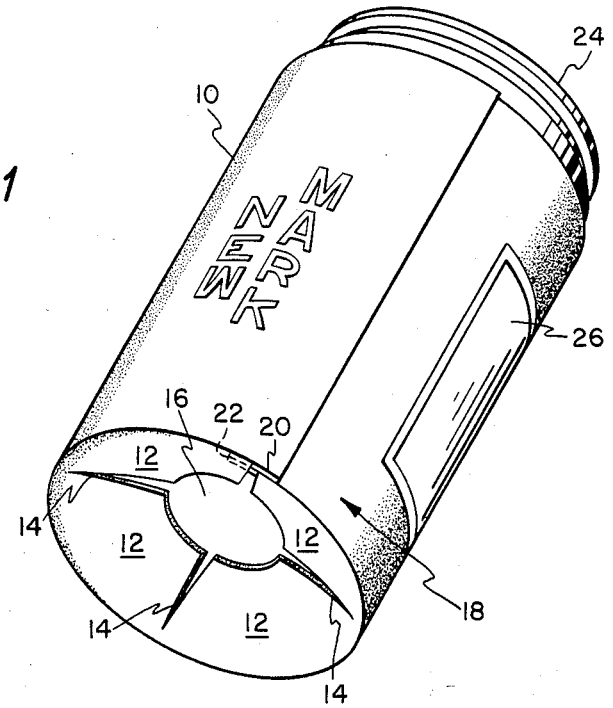
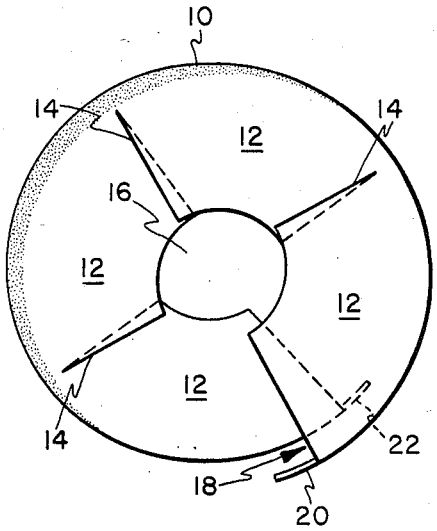
FIG. 2
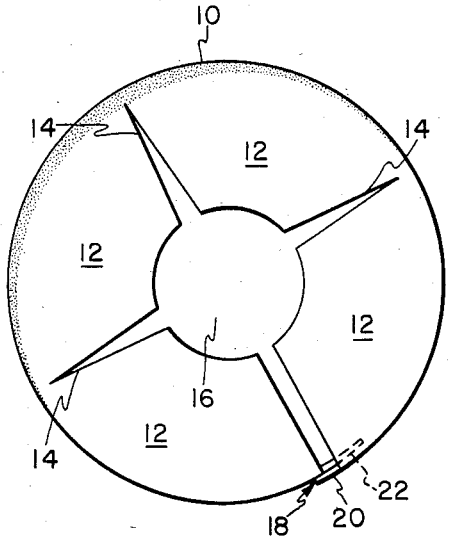
FIG. 3

CONTAINER INSULATOR

TECHNICAL FIELD

This invention relates to insulating devices and more particularly relates to flexible insulating wrappers for beverage containers and the like.

BACKGROUND ART

Beverages are frequently sold or distributed in individual containers. In many instances, the beverage is chilled and is intended for prompt consumption. It is readily apparent that a chilled beverage is quite likely to be consumed in a warm environment and it is also likely that the consumption will be intermittent with another activity. Conversely, heated liquids and beverages may be sold and consumed in cold weather.

Insulated holders have been provided for beverage containers in an attempt to maintain the beverage at a desired temperature. In some designs, flexible pouches are provided with insulating side walls. Such pouches may be difficult to attach and to handle.

Rigid insulating holders have been provided for ease of installation. In one design a rigid holder, typically of foamed plastic, is provided with a relatively rigid plastic ring having depending flexible tabs for holding the beverage container. Wrap-around cylinders have been provided with overlapping gripping strips to hold the insulator around the container.

However, these holders present a number of difficulties. Rigid, thick holders can hinder access to the container opening for drinking. The holders cannot be conveniently stacked or nested for compact storage. Wrap-around cylinders have not been provided with any surface beneath the beverage container and thus rely on a snug fit and friction to hold the beverage container within the open cylinder. In addition, most of the above insulators are too large to permit an insulated container to be placed within a supportive beverage holder typically available in cars, vans, boats and other recreational vehicles.

These and other disadvantages of the prior art are overcome by the present invention wherein an improved insulating cover is provided for beverage containers.

SUMMARY OF INVENTION

An insulating cover is provided for maintaining the temperature within an enclosed container. A resilient cylindrical sidewall member is provided with overlapping edges and a radius of curvature effective to surround the beverage container. A plurality of bottom segments are provided, each depending from the sidewall and slidingly overlapping adjacent segments as said radius of curvature is varied.

In an embodiment of the invention, the cover is formed of a foamed plastic effective to form a thermal set at a first radius of curvature smaller than that of conventional containers such as may be typically used for beverages.

It is a feature of one embodiment of the present invention to resiliently grip an enclosed beverage container.

It is another feature that the insulation be thin enough for the insulated container to be placed in conventional supportive holders.

It is yet another feature to provide a cylindrical cover which may be compactly nested for packing or shipping.

It is one other feature to permit a plurality of covers to be placed about a single container to increase the insulation.

These and other features and advantages of the present invention will become apparent from the following detailed description, wherein reference is made to the figures in the accompanying drawing.

BRIEF DESCRIPTION OF THE DRAWINGS

FIG. 1 is a pictorial illustration of one embodiment of an insulating cover according to the present invention in insulating relationship with a beverage container.

FIG. 2 is a bottom view of the cover depicted in FIG. 1 at a contracted radius of curvature.

FIG. 3 is a bottom view of the cover depicted in FIG. 1 at an expanded radius of curvature.

DETAILED DESCRIPTION

Referring now to FIG. 1, there is shown a pictorial illustration of one embodiment of an insulating cover according to the present invention. The insulating cover includes vertical cylinder 10 and bottom segments 12. Cylinder 10 is shown wrapped around and resiliently gripping container 24 such as may typically be used for recreational beverages.

Vertical cylinder 10 and bottom segments 12 are preferrably formed of a foamed plastic having an insulating cellular structure. The foamed material should disirably have some shrinkage when subjected to a relatively low heat, such as a conventional hair blow dryer. Then the appropriate material may be formed as a sheet, formed around a shaping cylinder having a selected radius of curvature and then heated. The vertical cylinder portion will tend to set to the selected radius of curvature and the portion below the shaping cylinder can shrink in conformity with a bottom surface. Slits 14 can thereafter be cut to form overlapping segments 12.

Alternatively, cylinder 10 can be sized and roll formed or heat set to a selected radius of curvature. A disc of foamed plastic may also be formed to a selected radius and with aperture 16 and slits 14 forming segments 12. Cylinder 10 can then be formed about the bottom disc and fused thereto with heat or conventional adhesives.

While many suitable foamed plastics may be found, a polyethylene foam or a polystyrene is preferred. These plastics have the desired characteristics: heat formable and settable, ability to bend and flex without cracking, available in thin sheets, etc. Foamed polyethylene can also be obtained in cross-linked form or treated using proprietary treatments of others to accept printing by most commercial inks and prints. Thus, design 26 may be printed for design or advertising purposes.

As hereinbelow explained in FIGS. 2 and 3, the entire insulating cover assumes a first radius of curvature set by the selected forming radius of curvature for cylinder 10. Bottom segments 12 may overlap one another if needed to vary the aperture 16 and conform to the radius of curvature of cylinder 10. Cylinder 10 defines edge portions 20 and 22 which form overlap 18 as a function of the radius of curvature of cylinder 10. It will be appreciated from FIG. 1 that cylinder 10 will resiliently form to the radius of curvature of container 24 and frictionally engage the walls of container 24.

Overlapping bottom segments 12 also conform to the radius of curvature of cylinder 10 and support container 24 within the holder. In a preferred configuation, overlapping segments 12 form a generally concave surface beneath container 24 concave upwards into cylinder 10. The concave configuration has a stable periphery when the container is placed on a horizontal surface and has improved strength for retaining container 24 within cylinder 10. Bottom segments 12 may also be formed generally flat with no loss of insulating or conformal properties.

The thickness of the foamed plastic sheet forming at least cylinder 10 is selected to permit an insulated container 24, such as a can, to fit within conventional beverage holders found in recreational-type vehicles. A thickness as low as about 1/64" has generally been found acceptable.

Referring now to FIG. 2, the insulated cover is shown with a reduced radius of curvature as for storing or packing. The edge portions 20 and 22 of cylinder 10 form considerable overlap 18. Preferrably cylinder 10 has been roll formed or heat treated to retain this reduced radius of curvature.

Bottom segments 12 are shown in overlapping relationship at slits 14 within the area left by cylinder 10. Aperture 16 has decreased in area as overlap 18 increased. It is apparent from FIG. 2 that bottom segments 12 operate in the manner of a camera iris to expand or contract the material within the bottom area bounded by cylinder 10.

In FIG. 3, the insulated cover is shown with an increased radius of curvature as may be needed to insert a container within cylinder 10. Overlap 18 is small and slits 14 are expanded to accommodate the increased area defined by cylinder 10. Slits 14 preferable terminate at a location within the perimeter of cylinder 10 to enable the elasticity of the material remaining beyond slits 14 to assist in resiliently gripping an inserted container.

Thus, the insulating cover may generally be expanded or contracted as shown by FIGS. 3 and 2, respectively. If expanded to accept a container, as exemplified in FIG. 3, cylinder 10 and bottom segments 12 begin to close toward the condition shown in FIG. 2 as the foamed plastic attempts to return to the original radius of curvature. Cylinder 10 is thus resiliently urged against container 24 (FIG. 1) for frictional contact and bottom segments 12 begin to overlap and form a concave surface for retaining container 24 within cylinder 10 independent of frictional contact.

The insulated cover herein described may also be conveniently and compactly packed for shipment and display. The variable radius of curvature of cylinder 10 and the thin wall thickness enables a significant quantity of covers to be nested, i.e., one placed within another, as the radius of cylinder 10 expands. It is also apparent that the insulated cover is equally effective over a range of container sizes and shapes within the range of the variable radius. The thin wall section further permits the top of the insulation to be placed near the top of the container without interferring with drinking from the container, even when a can with a tab opening is used.

The conformal ability of the insulated cover provides considerable flexibility in insulating a variety of containers. Several insulated covers may be nested to provide increased thickness for the insulation. A cover may be inverted and placed over the top of a container, overlapping the insulating cover on the container bottom. A variety of container shapes and sizes, such as long neck bottles, irregular configuration bottles or conical containers, can be accommodated by the subject insulated covers.

It is anticipated that the thin wall thickness of cylinder 10, the ability to grip and hold a container without auxiliary features as plastic rings or adhesive strip and the fabrication ease will enable the insulating covers to be made at a low cost. Thus, the covers may be disposable after one or a few uses. If desired, however, a gripping strip such as tape may be placed adjacent edges 20 and 22 or a gripping adhesive applied to one surface to assist in fixing the insulator cover's shape once it is slipped about a selected container.

As many possible embodiments may be made of this invention without departing from the spirit or scope thereof, it is to be understood that all matters herein set forth in the accompanying drawings are to be interpreted as illustrative and not any limiting sense.

What is claimed is:

1. An insulating cover for a container, comprising:

a resilient cylindrical sidewall member formed to a selected first radius of curvature and defining two vertical edges overlapping to increase said first radius of curvature, and a plurality of bottom wall segments each depending from said sidewall and separated by slits effective for slidingly overlapping adjacent bottom wall segments at said first radius of curvature in a generally concave configuration, said overlapping adjacent bottom wall segments defining an iris-like central aperture having a variable diameter.

2. A cover according to claim 1, wherein said sidewall member and bottom wall segments are formed from a thin sheet of insulating material selected from the group consisting of polyethylene foam or polystyrene.

3. A cover according to claim 1, wherein said slits have a first end adjacent said central aperture and a second end terminating within a perimeter defined by said sidewall member.

4. A cover according to claim 3, wherein said material forming said sidewall is thermosetting plastic.

5. An insulating cover for a container, comprising:

a cylindrical sidewall member of thermosetting plastic defining two overlapping vertical edges for resiliently expanding to a second radius of curvature from a first thermally set radius of curvature, a disk-like bottom member depending from said sidewall and defining a central aperture, a plurality of slits having a first end adjacent said central aperture and a second end within a perimeter defined by said sidewall member for separating said bottom member into a corresponding plurality of segments, and said slits cooperatively enabling said plurality of segments to overlap in an iris-like manner at said first radius of curvature.

6. A cover according to claim 5, wherein said overlapping plurality of segments defines a concave surface.

7. A cover according to claim 6, wherein said thermosetting material is selected from a group consisting of polyethylene foam or polystyrene.

* * * * *

UNITED STATES PATENT AND TRADEMARK OFFICE

CERTIFICATE OF CORRECTION

PATENT NO. : 4,583,577

DATED : APRIL 22, 1986

INVENTOR(S) : CHARLES L. CANFIELD

It is certified that error appears in the above-identified patent and that said Letters Patent is hereby corrected as shown below:

Column 2, line 32, delete "disirably" and insert --desirably--;

Column 3, line 35, delete "preferable" and insert --preferably--.

Signed and Sealed this

Seventh Day of October, 1986

[SEAL]

*Attest:*

DONALD J. QUIGG

*Attesting Officer*

*Commissioner of Patents and Trademarks*